US007036465B2

(12) United States Patent
Burk et al.

(10) Patent No.: US 7,036,465 B2
(45) Date of Patent: May 2, 2006

(54) TWO-STROKE AND FOUR-STROKE SWITCHING MECHANISM

(75) Inventors: Reinhard Burk, Canton, MI (US); Russell J. Wakeman, Canton, MI (US); Randall R. Ryan, Belleville, MI (US)

(73) Assignee: Ricardo, Inc., Van Buren Township, MI (US)

( * ) Notice: Subject to any disclaimer, the term of this patent is extended or adjusted under 35 U.S.C. 154(b) by 0 days.

(21) Appl. No.: 10/802,487

(22) Filed: Mar. 17, 2004

(65) Prior Publication Data

US 2005/0205019 A1 Sep. 22, 2005

(51) Int. Cl.
*F02B 69/06* (2006.01)

(52) U.S. Cl. ..... 123/21; 123/90.55

(58) Field of Classification Search ..... 123/21, 123/90.55, 90.56, 90.57, 90.58
See application file for complete search history.

(56) References Cited

U.S. PATENT DOCUMENTS

| | | | | |
|---|---|---|---|---|
| 629,904 | A | 8/1899 | Hirt | |
| 871,602 | A | 11/1907 | Löffler | |
| 1,274,777 | A | 8/1918 | Prescott | |
| 1,792,028 | A | 2/1931 | Peterson | |
| 2,178,152 | A | 10/1939 | Walker | |
| 3,019,776 | A | 2/1962 | Clavell | |
| 5,005,539 | A | 4/1991 | Kawamura | |
| 5,036,801 | A | 8/1991 | Imajou | |
| 5,154,141 | A | 10/1992 | McWhorter | |
| 5,158,044 | A | 10/1992 | Kawamura | |
| 5,193,492 | A | 3/1993 | Kawamura | |
| 5,517,951 | A | 5/1996 | Paul et al. | |
| 5,558,052 | A | 9/1996 | Schwarzenthal et al. | |
| 5,603,293 | A | 2/1997 | Schwarzenthal et al. | |
| 6,135,074 | A | 10/2000 | Kuhl | |
| 6,164,255 | A | 12/2000 | Maas et al. | |
| 6,192,846 | B1 | 2/2001 | Speil | |
| 6,213,076 | B1 | 4/2001 | Fischer et al. | |
| 6,257,176 | B1 | 7/2001 | Shimasaki et al. | |
| 6,257,185 | B1 | 7/2001 | Groh et al. | |
| 6,422,186 | B1 * | 7/2002 | Vanderpoel | 123/90.55 |
| 6,427,652 | B1 | 8/2002 | Faria et al. | |
| 6,499,452 | B1 | 12/2002 | Ma | |
| 6,564,764 | B1 | 5/2003 | Karbstein et al. | |
| 6,615,783 | B1 | 9/2003 | Haas et al. | |
| 2002/0117126 | A1 | 8/2002 | Kaneko | |

FOREIGN PATENT DOCUMENTS

| | | |
|---|---|---|
| JP | 06010695 | 1/1994 |

* cited by examiner

*Primary Examiner*—Noah P. Kamen
(74) *Attorney, Agent, or Firm*—Butzel Long

(57) ABSTRACT

A switching mechanism capable of switching between a two-stroke and a four-stroke operation of an engine as desired, wherein the switching mechanism is switchable between engagement with a first cam lobe for four-stroke operation and a second cam lobe for two-stroke operation, the four-stroke operation maximizing fuel and emissions efficiency and the two-stroke operation maximizing power.

23 Claims, 8 Drawing Sheets

TWO-STROKE AND FOUR-STROKE SWITCHING MECHANISM

FIELD OF THE INVENTION

The present invention relates to a switching mechanism and more particularly to a switching mechanism capable of switching between a two-stroke and a four-stroke operation of an engine as desired, wherein the switching mechanism is switchable between engagement with a first cam lobe for four-stroke operation and a second cam lobe for two-stroke operation.

BACKGROUND OF THE INVENTION

Conventional internal combustion engines operate according to thermodynamic principles following either a two-stroke cycle or a four-stroke cycle which are commonly classified as a two-stroke engine or a four-stroke engine, respectively. Both types of engines can operate using a range of fuels including gasoline, diesel, alcohol and gaseous fuels. The fuel is typically introduced into the engine using a range of devices including carburetors and fuel injectors, for example. The fuel-air mixture can be ignited by a range of methods including spark ignition and compression ignition. Each engine cycle type has different merits and shortcomings with varying power density, fuel consumption, exhaust emissions, noise, vibration, engine size, weight, cost, etc.

For ordinary driving conditions, a typical vehicle is powered by an engine that is sized for the maximum performance requirement of the vehicle. For example, a passenger vehicle passing another vehicle on a hill may for a brief period utilize the maximum power of the engine. At virtually all other times, from low speed city driving to highway cruising, the power demand is a fraction of the available power. Over-dimensioned engines with large displacements are therefore constructed to meet only occasional power demands.

The situation for large displacement working vehicles is even more dramatic. Freight hauling tractor-trailers, delivery trucks, and other vehicles are designed with engines to accommodate full loads. When traveling empty, the power requirement is substantially diminished. Similarly, marine engines often must shift from high speed or power operation to low speed where the engine operates in idle for long periods of time. Unused displacement or over displacement results in over-sized, large engines with a multiplicity of cylinders, having a weight and complexity resulting in an unnecessary consumption of fuel and excess pollution.

Existing internal combustion engines are usually limited in their operation to two-stroke or four-stroke cycles. The engines have a fixed fuel distribution system, optimized for a limited range of operation. With fixed compression ratios and limited means of optimizing performance for all ranges of power, torque, and engine speed, fuel consumption is typically characterized by a specific fuel consumption curve with one point of minimum fuel consumption.

Although certain improvements to engine design have addressed these problems, for example, the use of a turbocharger for high performance operation, satisfaction of power demand is at the expense of optimized fuel consumption.

Existing internal combustion engines have used switchable cam followers to actuate valves from multiple cam profiles to provide for variations in valve lash between one cam profile to the next. In a conventional system where a rocker arm or a cam follower operate with only a single cam profile, common practice is the use of a hydraulic valve adjuster that is pressurized by lubrication oil and held in a filled position using an internal check valve. These hydraulic valve adjusters have been placed in the block, in the head or in the rocker arm or cam follower itself and are very universal in their application. It is, however, inadequate in valve trains where multiple cam profiles actuate the valves through the use of rocker arms or cam followers that by some means switch from one profile to another.

It would be desirable produce a switching mechanism for switching an engine from two-stroke to four-stroke operation wherein fuel efficiency, emissions efficiency, and power are maximized.

SUMMARY OF THE INVENTION

Consistent and consonant with the present invention, a switching mechanism for switching an engine from two-stroke to four-stroke operation wherein fuel efficiency, emissions efficiency, and power are maximized, has surprisingly been discovered.

The switching mechanism for switching an engine from one stroke type to another stroke type comprises:

- a first pair of pins, a first end of each of the first pair of pins in communication with a pressure fluid and a second end of each of the first pair of pins urged by a spring; and
- a switching mechanism adapted to transform a rotary motion of a cam shaft to a linear motion of a valve, the switching mechanism housing the first pair of pins and being adapted to engage a two-stroke cam surface and a four-stroke cam surface of the cam shaft, whereby a change in pressure of the pressure fluid causes a movement of at least one of the first pair of pins to stop the transformation of motion from one of the two-stroke cam surface and the four-stroke cam surface to the valve.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENT

Figure 1:
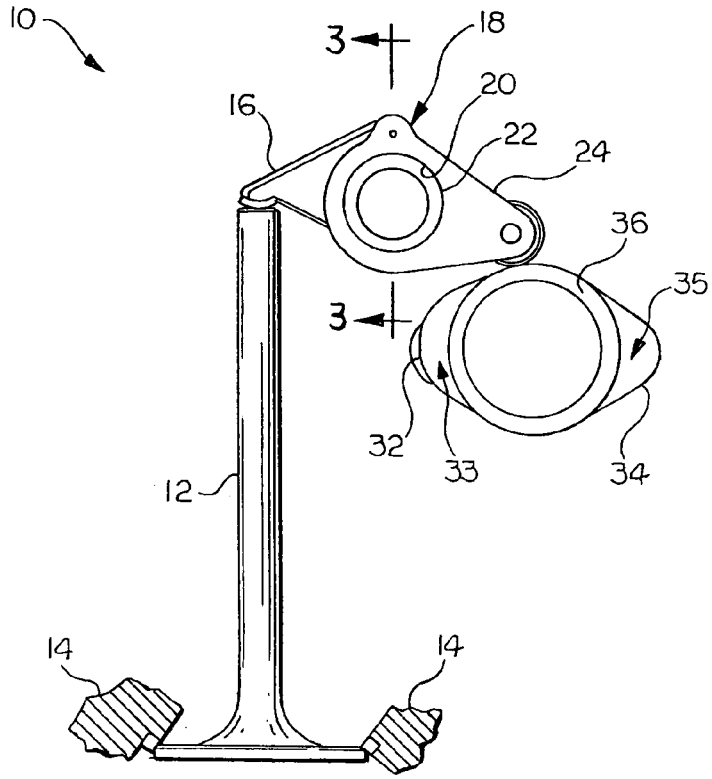
FIG. 1 is a schematic left side elevational view of a mechanism for switching an engine from one stroke type to another stroke type including an engine valve, rocker, and cam shaft assembly in accordance with the present invention.

Referring now to FIG. 1, there is shown generally at 10 a schematic left side elevational view of a mechanism for switching an engine from one stroke type to another stroke type or an engine valve actuating assembly in accordance with the present invention. An engine valve 12 has one end thereof seated in a cylinder block 14. The other end of the valve 12 abuts a rocker arm 16 of a rocker assembly 18. An aperture 20 formed in the rocker assembly 18 receives a hollow rocker shaft 22 therein. The number of the valves 12 provided varies depending upon the number of cylinders provided in an automobile engine (not shown).

Figure 2:
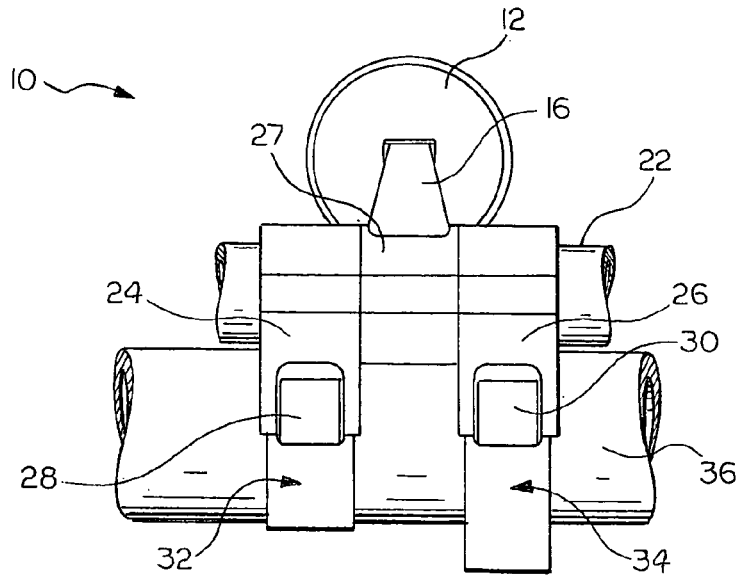
FIG. 2 is a schematic top view of the assembly shown in FIG. 1.

As clearly illustrated in FIG. 2, a pair of spaced apart follower arms 24, 26 extend outwardly from the rocker assembly 18 in a direction away from the valve 12. The follower arms 24, 26 have a linking member 27 disposed therebetween. A follower roller 28, 30 is respectively disposed on a distal end of each of the follower arms 24, 26. The follower roller 28 is operably engaged with a four-stroke cam surface 32 and the follower roller 30 is operably engaged with a two-stroke cam surface 34. The four-stroke cam surface 32 and the two-stroke cam surface 34 are disposed on an outer surface of a cam shaft 36.

Figure 3:
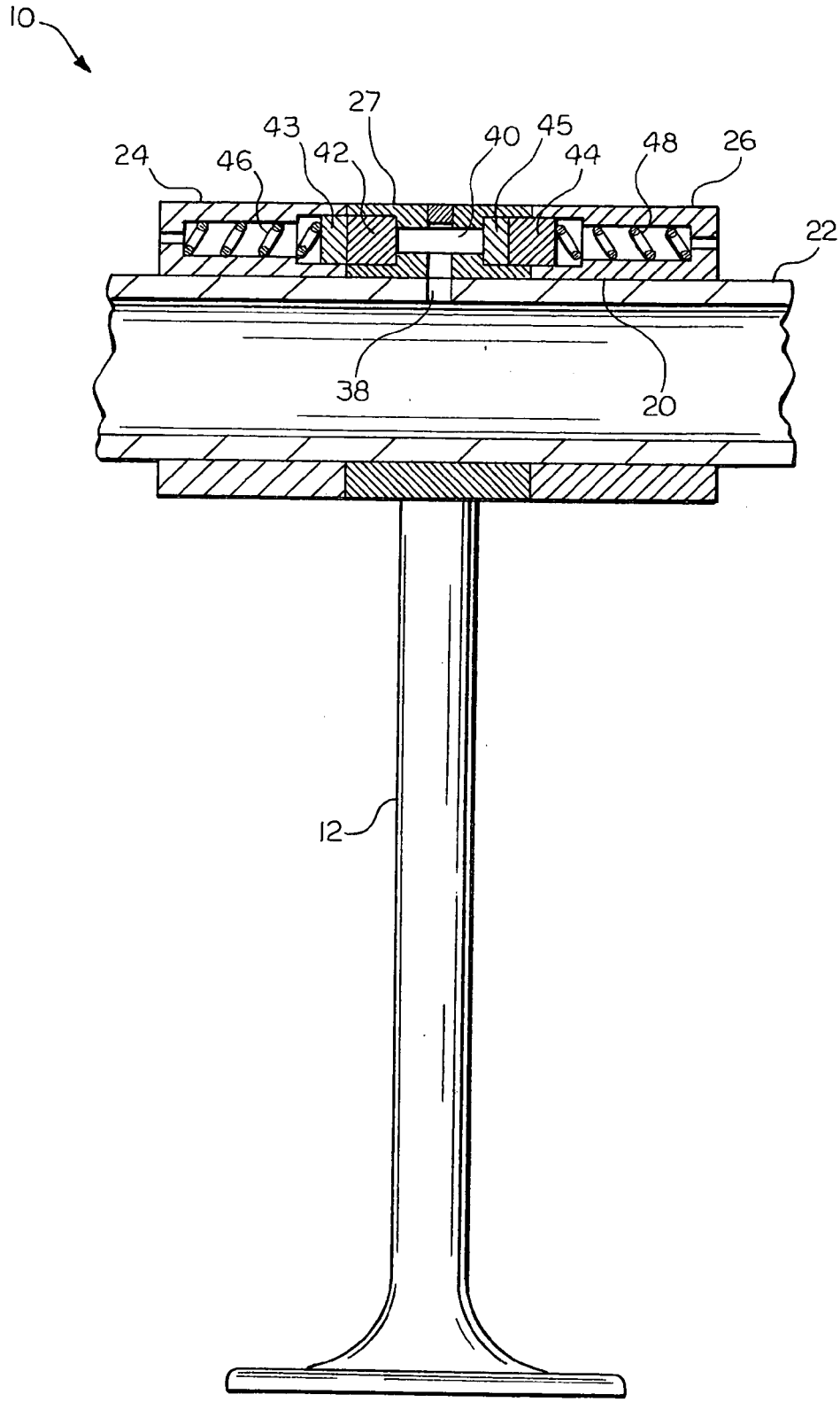
FIG. 3 is a schematic sectional view of the assembly shown in FIG. 1 taken along line 3—3.

FIG. 3 shows a schematic sectional view of the engine valve actuating assembly 10 shown in FIG. 1 taken along line 3—3. The rocker shaft 22 has a radial bore 38 formed therein. The radial bore 38 provides communication between the hollow portion of the rocker shaft 22 and a pressure fluid chamber 40 formed in the linking member 27 of the rocker assembly 18. A first locking pin 42 and a second locking pin 44 are disposed in opposing ends of the pressure fluid chamber 40. A third pin 43 is disposed adjacent the first locking pin 42 on a side opposite the second locking pin 44. A fourth pin 45 is disposed adjacent the second locking pin 44 on a side towards the first locking pin 42. A first return spring 46 with at least a portion thereof disposed in a bore formed in the follower arm 24 urges the third pin 43 and the first locking pin 42 towards the middle portion of the pressure fluid chamber 40 or towards the second locking pin 44. A second return spring 48 with at least a portion thereof disposed in a bore formed in the follower arm 26 urges the second locking pin 44 and the fourth pin 45 towards the middle portion of the pressure fluid chamber 40 or towards the first locking pin 42.

In operation, the engine is typically operated in a standard mode, one of the four-stroke and the two-stroke mode. For illustrative purposes, standard operation will be considered four-stroke operation. Operation of the valve 12 is controlled by the rocker assembly 18. As the cam shaft 36 rotates, a lobe 33 of the four-stroke cam surface 32 is caused to rotate through 360 degrees. As the lobe 33 of the four-stroke cam surface 32 passes under the follower roller 28, the rocker assembly 18 is caused to pivot about the rocker shaft 22. Thus, the distal end of the rocker arm 16 is caused to move downwardly causing the valve 12 to open. As the lobe 33 of the four-stroke cam surface 32 moves beyond the follower roller 28, the rocker arm 16 is caused to move upwardly and the valve 12 is caused to close. Operation of the valve 12 by the lobes 35 of the two-stroke cam surface 34 is the same as that described for the lobe 33 of the four-stroke cam surface 32.

The engine, which has a combustion system suitable for both two-stroke and four-stroke operation, can be changed from one operating mode to another by changing from the operation of the valve 12 from once per revolution of the cam shaft 36 or crank to twice per revolution of the cam shaft 36. This is accomplished by switching the engine valve 12 from following the four-stroke cam surface 32 to following the two-stroke cam surface 34. The first locking pin 42 operates to lock and engage the follower arm 24 for four-stroke mode. The second locking pin 44 operates to lock and engage the follower arm 26 for two-stroke mode. The third pin 43 ensures proper alignment of the first locking pin 42 to engage the follower arm 24 for the four-stoke mode. The fourth pin 45 ensures proper alignment of the second locking pin 44 to engage the follower arm 26 for the two-stroke mode. In the embodiment shown, when one of the first locking pin 42 and the second locking pin 44 is engaged with the respective follower arm 24, 26, the other of the first locking pin 42 and the second locking pin 44 is disengaged from the respective follower arm 24, 26.

Engagement and disengagement of the first locking pin 42 and the second locking pin 44 is accomplished by a hydraulic pressure applied which is controlled by a solenoid valve based on a signal from an engine management system. A pressure fluid such as engine oil, for example, is supplied to the hollow portion of the rocker shaft 22. The pressure fluid enters the radial bore 38 and the pressure fluid chamber 40 and urges the first locking pin 42 and the third pin 43 to move against the force of the first return spring 46 and the second locking pin 44 and the fourth pin 45 to move against the force of the second return spring 48. In the embodiment shown, when it is desired to operate in the four-stroke mode, the pressure fluid causes the first locking pin 42 to move in a direction against the force of the first return spring 46 to engage the follower arm 24. The second locking pin 44 is likewise caused to move in a direction against the force of the second return spring 48 to disengage the follower arm 26. The split between the second locking pin 44 and the fourth pin 45 facilitates the disengagement of the follower arm 26. When it is desired to operate in the two-stroke mode, a flow or pressure of the pressure fluid is reduced and the force of the second return spring 48 causes the second locking pin 44 to move to the position shown in FIG. 3 and engage the follower arm 26. The first locking pin 42 and the third pin 43 are likewise caused to move to the position shown in FIG. 3, thus disengaging the follower arm 24. The split between the first locking pin 42 and the third pin 43 facilitates the disengagement of the follower arm 24.

Figure 5:
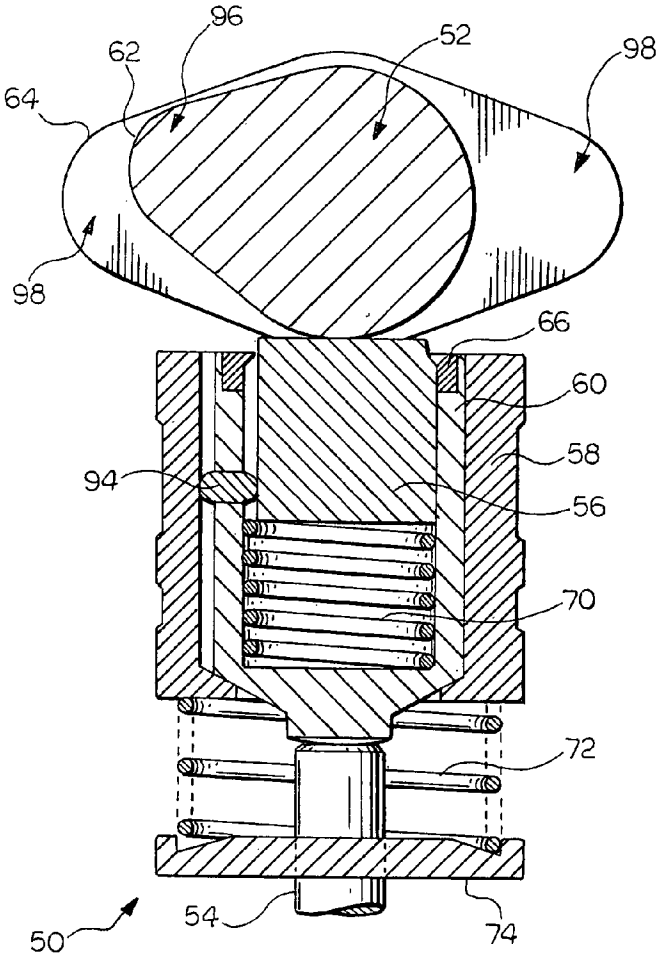
FIG. 5 is a schematic sectional view of the switching tappet and the cam shaft of FIG. 4 taken along line 5—5.
Figure 4:
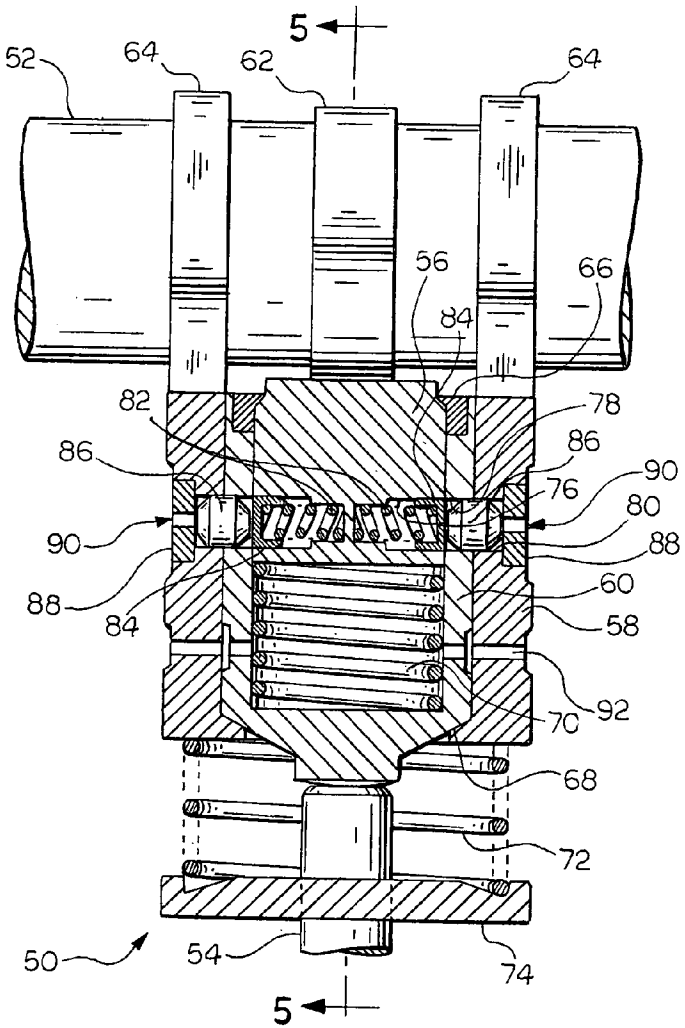
FIG. 4 is a schematic front elevational view of a second embodiment in accordance with the present invention showing a mechanism for switching an engine from one stroke type to another stroke type including a switching tappet in section and a cam shaft.

Referring now to FIGS. 4 and 5, there is shown generally at 50 a schematic front elevational view of a mechanism for switching an engine from one stroke type to another stroke type or switching tappet assembly which represents a second embodiment of the present invention. The tappet assembly 50 is disposed between a cam shaft 52 and a valve stem 54. The tappet assembly 50 includes an inner tappet 56 and an outer tappet 58. A valve plunger 60 is disposed between the inner tappet 56 and the outer tappet 58, and is substantially concentric therewith. The inner tappet 56 abuts a four-stroke cam surface 62 of the cam shaft 52 and the outer tappet 58 abuts a pair of two-stroke cam surfaces 64. It is understood that the inner tappet 56 could abut a two-stroke cam surface and the outer tappet 58 could abut four-stroke cam surfaces without departing from the scope and spirit of the invention. An inner tappet stop ring 66 militates against separation of the inner tappet 56 from the valve plunger 60. An outer tappet stop 68 formed on the opposite end of the outer tappet 58 from the inner tappet stop ring 66 militates against separation of the valve plunger 60 from the outer tappet 58.

The inner tappet 56 is maintained in contact with the four-stroke cam surface 62 by an inner tappet return spring 70. One end of an outer tappet return spring 72 urges the outer tappet 58 to maintain contact with the two-stroke cam surfaces 64 of the cam shaft 52. The other end of the outer tappet return spring 72 abuts a spring retainer 74.

Lateral holes 76 are formed in opposing sides of the inner tappet 56 and are aligned with a hole 78 formed in the valve plunger 60 and a hole 80 formed in the outer tappet 58. Locking pin return springs 82 are disposed in the holes 76 of the inner tappet 56. One end of each of the locking pin return springs 82 is received in a locking pin plunger 84. A locking pin 86 is disposed on a side of the locking pin plunger 84 opposite the locking pin return springs 82 and is slidingly received in the holes 76, 78, 80. A pair of locking pin retainers 88 prevent each of the locking pins 86 from sliding free of the outer tappet 58. Each of the locking pin retainers 88 has a central aperture 90 formed therein and is in communication with a pressure fluid source (not shown). A lubrication and lash adjustment aperture 92 is also formed in the outer tappet 58 and the valve plunger 60. As clearly shown in FIG. 5, an antirotation pin 94 is disposed in a wall of the valve plunger 60 and abuts the inner tappet 56 and the outer tappet 58.

In operation, the engine is typically operated in a standard mode, one of the four-stroke and the two-stroke mode. For illustrative purposes, standard operation will be considered four-stroke operation. Actuation of the valve stem 54 is controlled by the tappet assembly 50. As the cam shaft 52 rotates, a lobe 96 of the four-stroke cam surface 62 is caused to rotate through 360 degrees. As the lobe 96 of the four-stroke cam surface 62 rotates into the inner tappet 56, the inner tappet 56 is caused to move downwardly, thus causing the valve stem 54 to move downwardly and open a valve (not shown). As the lobe 96 of the four-stroke cam surface 62 moves beyond the inner tappet 56, the inner tappet 56 is caused to move upwardly, thus causing the valve stem 54 to move upwardly and close the valve. Downward movement of the valve stem 54 by a pair of lobes 98 of the two-stroke cam surface 64 is caused by the lobes 98 causing the outer tappet 58 to move downwardly, similar to that described for the lobe 96 of the four-stroke cam surface 62. The outer tappet return spring 72 causes the tappet assembly 50 to maintain contact with the lobes 96, 98 of the cam shaft 52 and return to the position shown in FIG. 4 when the lobes 96, 98 have passed the respective inner tappet 56 and outer tappet 58.

The engine, which has a combustion system suitable for both two-stroke and four-stroke operation, can be changed from one operating mode to another by changing from the actuation of the valve stem 54 from once per revolution of the cam shaft 52 or crank to twice per revolution of the cam shaft 52. This is accomplished by switching the tappet assembly 50 from following the four-stroke cam surface 62 to following the two-stroke cam surface 64. In the embodiment shown, the locking pins 86 operate to unlock and disengage the valve plunger 60 from the outer tappet 58 for four-stroke mode. Conversely, the locking pins 86 operate to lock and engage the valve plunger 60 to the outer tappet 58 for two-stroke mode.

Engagement and disengagement of the locking pins 86 is accomplished by a hydraulic pressure applied to the locking pins 86 by a solenoid valve under the control of an engine management system. A pressure fluid such as engine oil, for example from the pressure fluid source, is supplied through the apertures 90 to the locking pins 86. The pressure fluid causes the locking pins 86 to move inwardly and disengage the valve plunger 60 from the outer tappet 58 for four-stroke mode. The pressure fluid enters the radial bore apertures 90 and urges the locking pins 86 against the force of the locking pin return springs 82. Thus, when it is desired to operate in the four-stroke mode, the pressure fluid causes the locking pins 86 to move inwardly from the position shown in FIG. 4 and disengage the valve plunger 60 from the outer tappet 58. Therefore, when the outer tappet 58 is urged downwardly by the lobes 98 of the two-stroke cam surface 64, the outer tappet 58 slides freely on the outer portion of the valve plunger 60 and does not cause actuation of the valve stem 54. In the embodiment shown, when it is desired to operate in the two-stroke mode, a flow or pressure of the pressure fluid is reduced and the force of the locking pin return springs 82 cause the locking pins 86 to move to the position shown in FIG. 4 and engage the valve plunger 60 to the outer tappet 58. Therefore, when the outer tappet 58 is urged downwardly by the lobes 98 of the two-stroke cam surface 64, the outer tappet 58 and the valve plunger 60 both are caused to move downwardly and cause actuation of the valve stem 54. As can be clearly understood, the locking pins 86 are designed so that they can only engage either the inner tappet 56 to the valve plunger 60 or the outer tappet 58 to the valve plunger 60 at one time. It should be noted that the outer tappet 58 is caused to move with the inner tappet 56 and the plunger 60 when disengaged due to the outer tappet stop 68. Additionally, the locking pins 86 are formed with chamfers for the purpose of driving the locking pins 86 to a fully locked position should the controlled switching motion be too slow or insufficient to accomplish safe locking.

Figure 7:
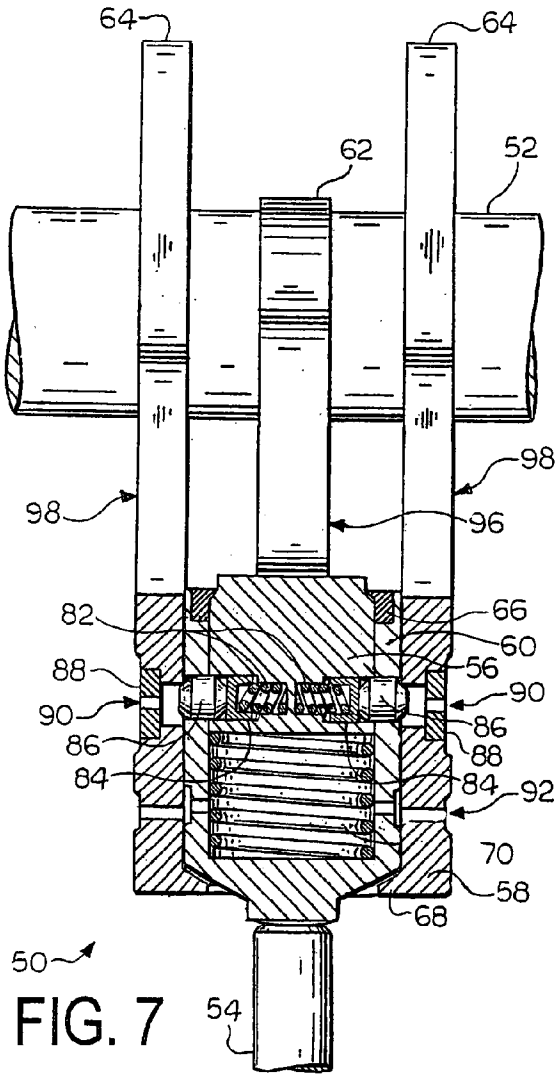
FIG. 7 is a schematic front elevational view of the switching tappet and the cam shaft of FIGS. 4 and 6 showing the locking pin in a position to cause transfer of motion from a four-stroke cam only and with the tappet in a full lift position.
Figure 6:
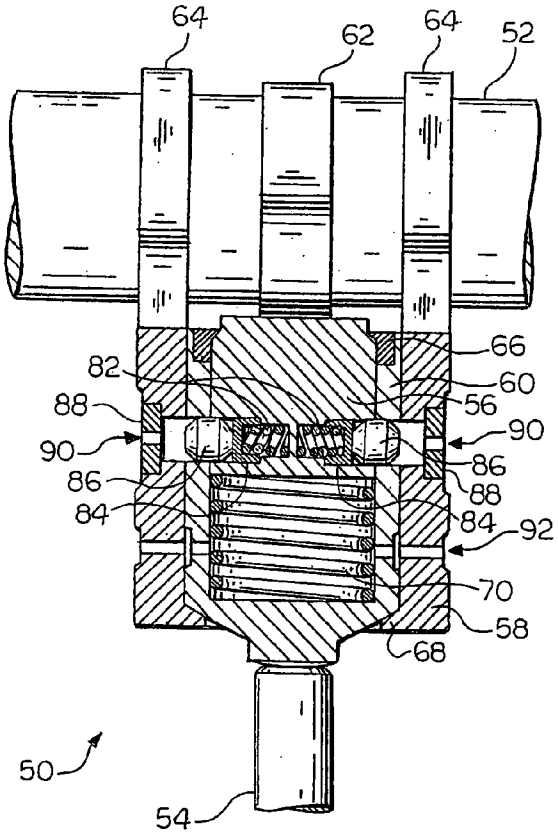
FIG. 6 is a schematic front elevational view of the switching tappet and the cam shaft of FIG. 4 showing a locking pin in a position to cause transfer of motion from a four-stroke cam only and with the tappet in a base circle position.
Figure 9:
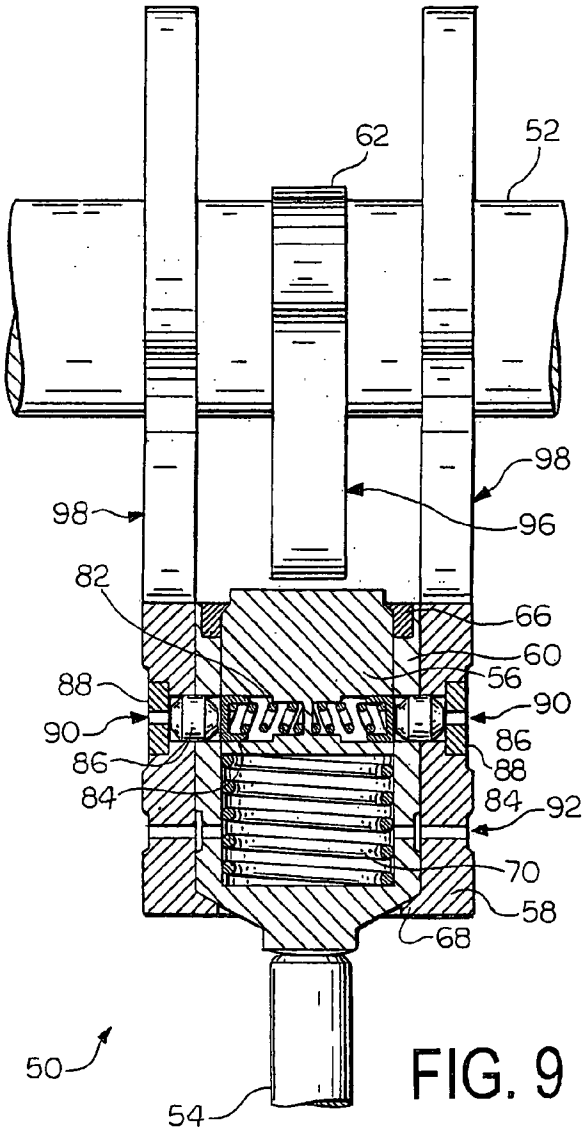
FIG. 9 is a schematic front elevational view of the switching tappet and the cam shaft of FIGS. 4 and 8 showing the locking pin in a position to cause transfer of motion from the two-stroke cams only and with the tappet in a full lift position.
Figure 8:
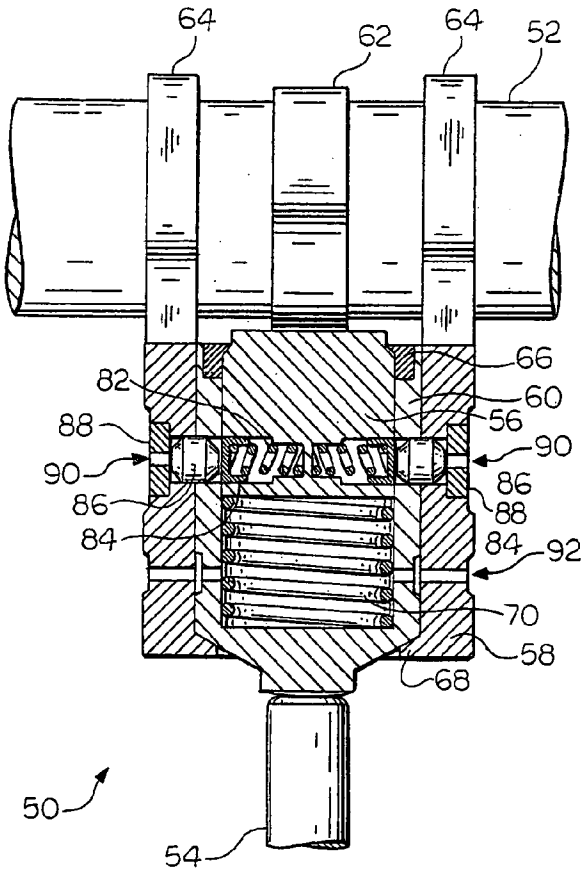
FIG. 8 is a schematic front elevational view of the switching tappet and the cam shaft of FIG. 4 showing a locking pin in a position to cause transfer of motion from two-stroke cams only and with the tappet in a base circle position.

FIGS. 6, 7, 8, and 9 illustrate the position of the tappet assembly 50 during operation. FIG. 6 shows the tappet assembly 50 at a base position during four-stroke mode and FIG. 7 shows the tappet assembly 50 at a full lift position during four-stroke mode. FIG. 8 shows the tappet assembly 50 at a base position during two-stroke mode and FIG. 7 shows the tappet assembly 50 at a full lift position during two-stroke mode.

Figure 11:
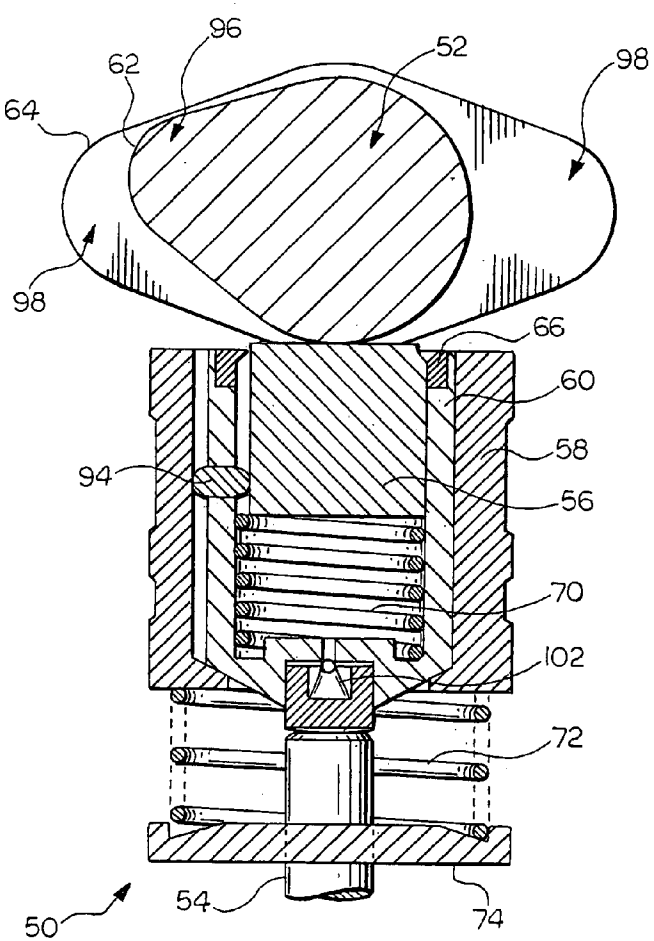
FIG. 11 is a schematic front elevational view of the switching tappet and the cam shaft of FIG. 4 showing a hydraulic type lash adjustment.
Figure 10:
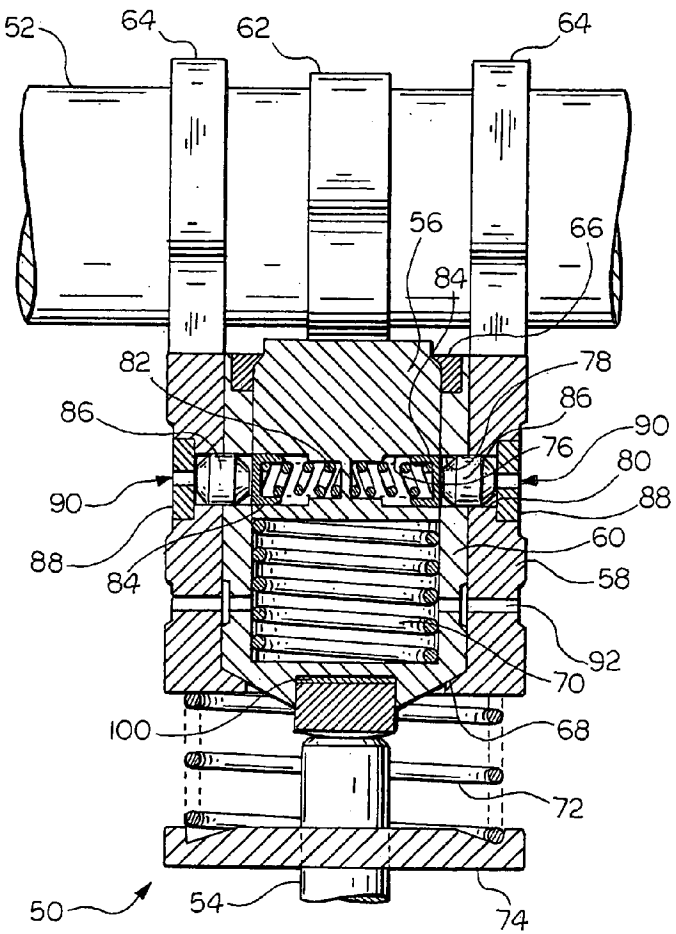
FIG. 10 is a schematic front elevational view of the switching tappet and the cam shaft of FIG. 4 showing a mechanical type lash adjustment.

FIGS. 10 and 11 show the tappet assembly 50 of FIGS. 4 and 5 including examples of two different lash adjustment types. FIG. 10 uses a lash shim 100 to manually make up for the clearance or play between the tappet assembly 50 and the valve stem 54. FIG. 11 uses a hydraulic check ball and spring type lash adjustment assembly 102 to make up for the clearance or play between the tappet assembly 50 and the valve stem 54. It is understood that other lash types could be used without departing from the scope and spirit of the invention.

Figure 12:
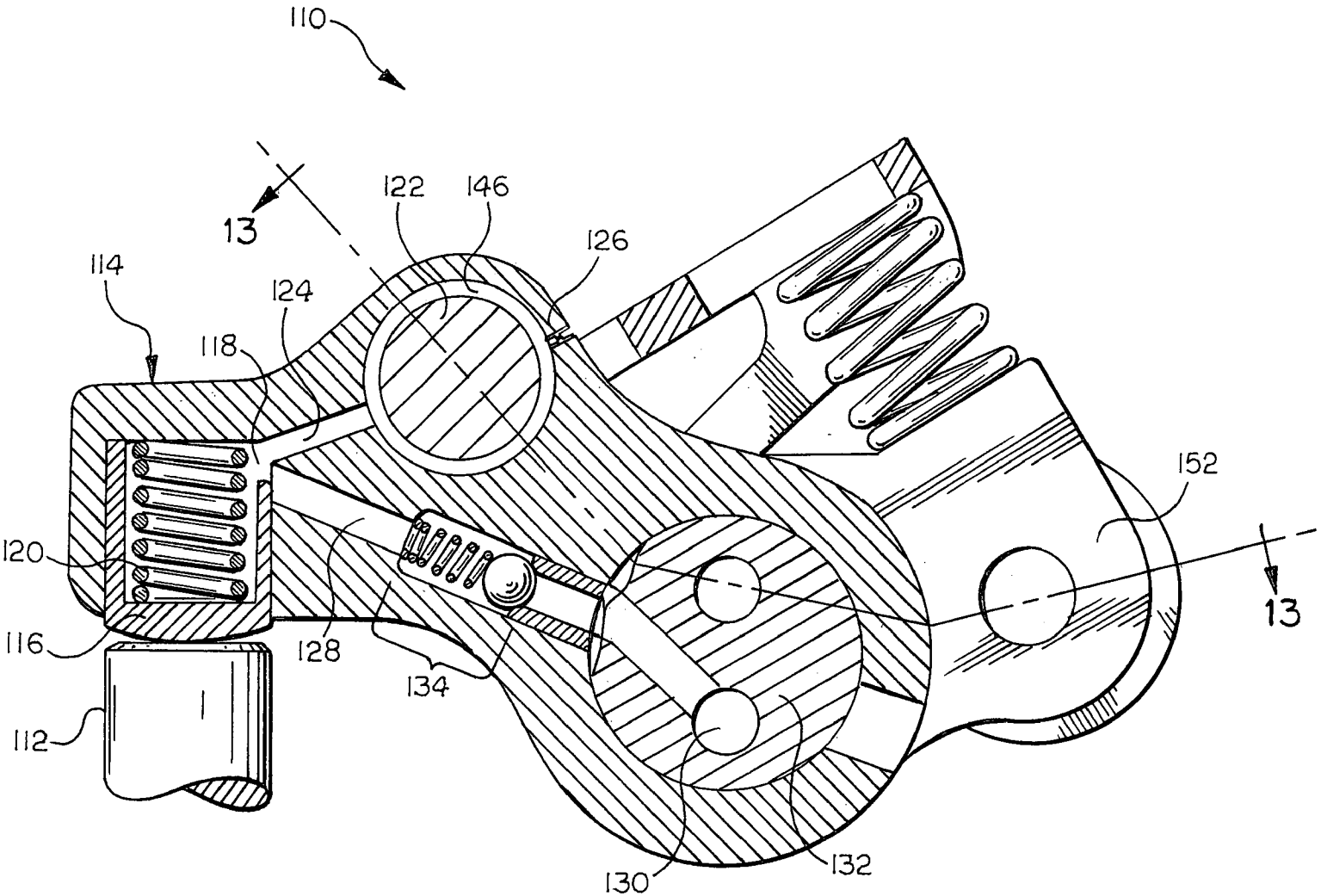
FIG. 12 is a schematic side sectional view of a third embodiment in accordance with the present invention showing a mechanism for switching an engine from one stroke type to another stroke type including a cam follower and rocker arm assembly.
Figure 13:
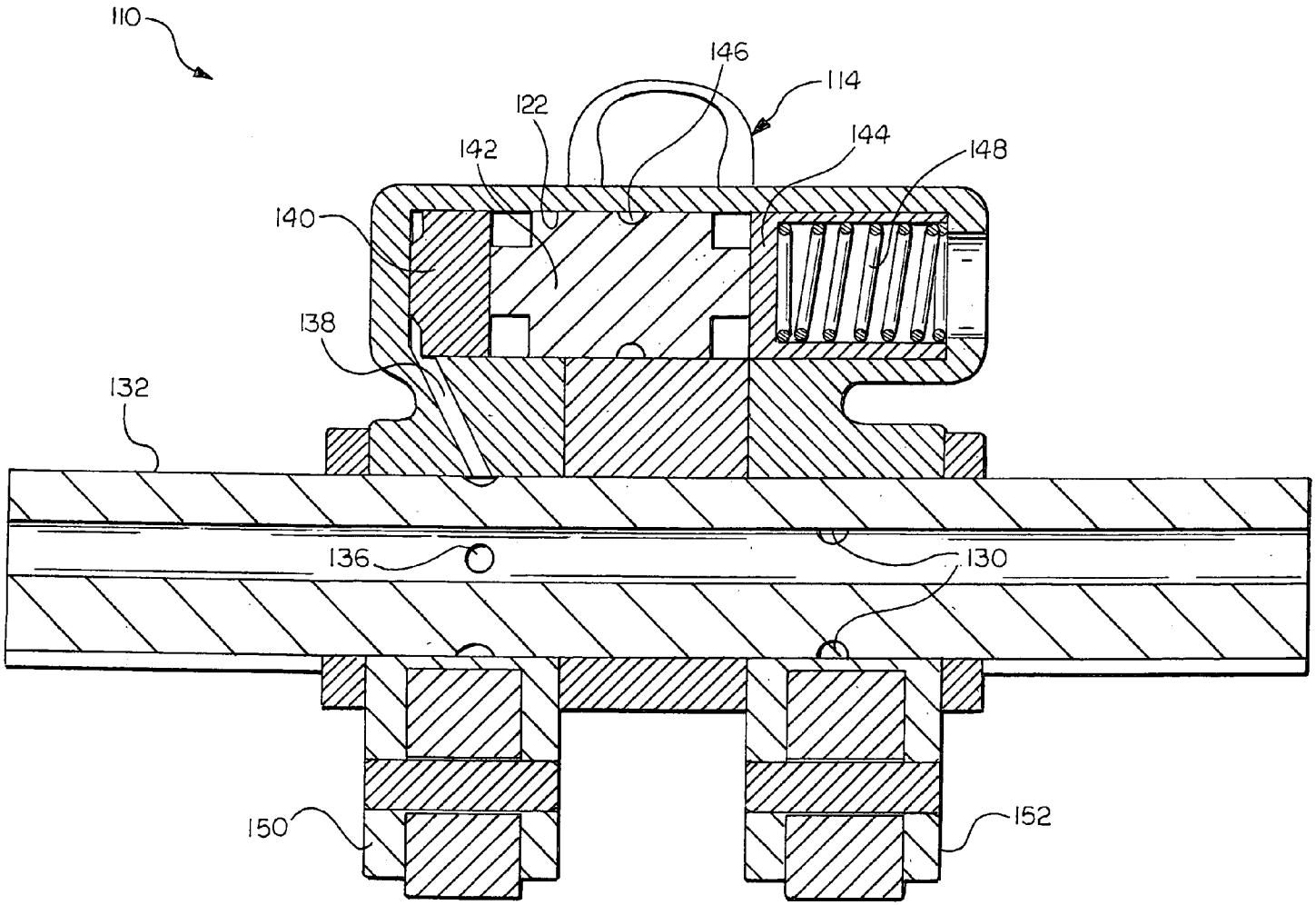
FIG. 13 is a schematic sectional view of the assembly of FIG. 12 taken along line 13—13.

A third embodiment of the invention is illustrated in FIGS. 12 and 13. In FIG. 12, there is shown generally at 110 a schematic side sectional view of a mechanism for switching an engine from one stroke type to another stroke type or a cam follower and rocker arm assembly. A valve stem 112 abuts an end of a rocker arm assembly 114. A piston 116 is disposed in a hydraulic lash adjustment cavity 118 formed within the rocker arm assembly 114. The piston 116 is urged into engagement with the valve stem 112 by a spring 120. Fluid communication between the hydraulic lash adjustment cavity 118 and a shuttle pin cavity 122 is provided by a first conduit 124. An exhaust orifice 126 provides fluid communication between the shuttle pin cavity 122 and the atmosphere. A second conduit 128 provides fluid communication between the hydraulic lash adjustment cavity 118 and a first axially extending oil supply conduit 130, which is in communication with a first oil supply (not shown). As illustrated, the first oil supply conduit 130 is formed in a rocker shaft 132 and includes an annular array of radially extending passages. Other routes of supply to the second conduit 128 and the hydraulic lash adjustment cavity 118 can be used as desired. A check valve 134 is disposed in the second conduit 128.

Referring now to FIG. 13, there is shown a schematic sectional view of the cam follower and rocker arm assembly 110 of FIG. 12 taken along line 13—13. A second axially extending oil supply conduit 136 having an annular array of radially extending passages is formed in the rocker shaft 132 and is in communication with a second oil supply (not shown). A third conduit 138 provides fluid communication between the second oil supply conduit 136 and the shuttle pin cavity 122. A shuttle pin piston 140 is reciprocatively disposed in one end of the shuttle pin cavity 122 adjacent the third conduit 138. A first end of a shuttle pin 142 abuts the shuttle pin piston 140. A second end of the shuttle pin 142 abuts a shuttle pin return piston 144. The shuttle pin 142 has a circumferrential groove 146 formed thereon at a point between the first end and the second end thereof. A shuttle pin return spring 148 urges the shuttle pin return piston 144, the shuttle pin 142, and the shuttle pin piston 140 in a direction towards the end of the shuttle pin cavity 122 communicating with the third conduit 138. A four-stroke follower arm 150 and a two-stroke follower arm 152 respectively abut four-stroke and two-stroke cam surfaces of a cam shaft (not shown). The four-stroke follower arm 150 and the two-stroke follower arm 152 are adapted to operate independently of one another, as described in the operation of the cam follower and rocker arm assembly 110.

In operation, the cam follower and rocker arm assembly 110 facilitates a selection of either a four-stroke or a two-stroke operation of an internal combustion engine (not shown) by switching between engagement of the four-stroke follower arm 150 and the two-stroke follower arm 152. The cam follower and rocker arm assembly 110 also allows compliance with manufacturing tolerance variation by incorporating a hydraulic lash adjustment device, which includes the piston 116 and the spring 120, that is deactivated while switching between the four-stroke follower arm 150 and the two-stroke follower arm 152. In both FIG. 12 and FIG. 13, the shuttle pin 142 is shown in a deactivated position with the shuttle pin 142 urged towards engagement of the four-stroke follower arm 150 by the shuttle pin return spring 148.

Under normal operating conditions, as illustrated, the internal combustion engine is running in the four-stroke mode which is determined by the engagement of the four-stroke follower arm 150 by the shuttle pin 142. The shuttle pin 142 and shuttle pin piston 140 are held in this position by due to the urging of the shuttle pin return spring 148. Thus, the actuation of the valve stem 112 will be controlled by the four-stroke follower arm 150. Pressurized oil is supplied to the hydraulic lash adjustment cavity 118 through the first oil supply conduit 130, via the second conduit 128. Control of the supply of pressurized oil can be accomplished using any conventional control method such as an on-board vehicle computer and control valve system, for example. The check valve 134 militates against backflow of the oil through the second conduit 128 to prevent depressurization of the hydraulic lash adjustment cavity 118 during operation.

When it is desired or required to switch to the two-stroke operation mode, pressurized oil is supplied to the shuttle pin cavity 122 through the second oil supplying conduit 136, via the third conduit 138. Control of the supply of pressurized oil can be accomplished using any conventional control method such as an on-board vehicle computer and control valve system, for example. The pressurized oil introduced to the shuttle pin cavity 122 urges the shuttle pin piston 140, the shuttle pin 142, and the shuttle pin return piston 144 against the force of the shuttle pin return spring 148 causing them to move against the force of the shuttle pin return spring 148. At a point in the travel of the shuttle pin 142, the groove 146 aligns with and communicates with the first conduit 124 and the exhaust orifice 126. This alignment, in essence allowing the shuttle pin 142 to act as a spool valve, allows depressurization of the hydraulic lash adjustment cavity 118 and deactivates the hydraulic lash adjustment device. Upon full travel of the shuttle pin piston 140, the shuttle pin 142, and the shuttle pin return piston 144, the four-stroke follower arm 150 is disengaged by the shuttle pin 142 and the two-stroke follower arm 152 is engaged by the shuttle pin 142. Communication between the groove 146, the first conduit 124, and the exhaust orifice 126 is also interrupted, thus allowing re-pressurization of the hydraulic lash adjustment cavity 118 to re-activate the hydraulic lash adjustment device to resume the function of taking up or compensating for clearances between the valve stem 112 and the rocker arm assembly 114.

To return to the four-stroke mode, the reverse of the above is accomplished. The oil supply to the shuttle pin cavity 122 is interrupted and vented, thus relieving the pressure and allowing the shuttle pin return spring 148 to cause the shuttle pin return piston 144, the shuttle pin 142, and the shuttle pin piston 140 to move in the shuttle pin cavity 122 in the direction of the force of the shuttle pin return spring 148. The groove 146 again aligns with and communicates with the first conduit 124 and the exhaust orifice 126 to allow depressurization of the hydraulic lash adjustment cavity 118 and deactivate the hydraulic lash adjustment device. Upon full travel of the shuttle pin return piston 144, the shuttle pin 142, and the shuttle pin piston 140, the four-stroke follower arm 150 is re-engaged by the shuttle pin 142 and the two-stroke follower arm 152 is disengaged by the shuttle pin 142. Communication between the groove 146, the first conduit 124, and the exhaust orifice 126 is also interrupted, thus allowing re-pressurization of the hydraulic lash adjustment cavity 118 to re-activate the hydraulic lash adjustment device.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A mechanism for switching an engine from one stroke type to another stroke type comprising:

a first pair of pins, a first end of each of said first pair of pins in at least one of direct and indirect communication with a pressure fluid and a second end of each of said first pair of pins urged by respective ones of a first pair of springs; and a switching mechanism adapted to transform a rotary motion of a cam shaft to a linear motion of a valve, said switching mechanism housing said first pair of pins and being adapted to engage a two-stroke cam surface and a four-stroke cam surface of the cam shaft, whereby a change in pressure of the pressure fluid causes a movement of at least one of said first pair of pins to stop the transformation of motion from one of the two-stroke cam surface and the four-stroke cam surface to the valve.

2. The mechanism according to claim 1, wherein said switching mechanism further comprises a rocker assembly having a rocker arm operatively engaging the valve, a first follower arm operatively engaging the four-stroke cam surface, and a second rocker arm operatively engaging the two-stroke cam surface, wherein one of said first pair of pins is caused to engage and disengage the first follower arm and the other of said first pair of pins is caused to engage and disengage the second follower arm.

3. The mechanism according to claim 2, wherein the rocker assembly includes a pressure fluid chamber disposed between said first pair of pins.

4. The mechanism according to claim 3, wherein one of the first pair of springs is disposed on a side of one of said first pair of pins opposite the pressure fluid chamber and the other of the first pair of springs is disposed on a side of the other of said first pair of pins opposite the pressure fluid chamber.

5. The mechanism according to claim 4, including a second pair of pins, one of the second pair of pins disposed adjacent one of said first pair of pins and the other of the second pair of pins disposed adjacent the other of said first pair of pins, wherein the second pair of pins ensures proper alignment of the first pair of pins for engagement and disengagement of the first follower arm and the second follower arm.

6. The mechanism according to claim 1, wherein said switching mechanism further comprises a tappet assembly including an outer tappet operatively engaging the two-stroke cam surface, an inner tappet operatively engaging the four-stroke cam surface, and a valve plunger operatively engaging the valve.

7. The mechanism according to claim 6, wherein said first pair of pins is caused to engage the outer tappet with the valve plunger and disengage the inner tappet from the valve plunger to operate in a two-stroke mode, and said first pair of pins is caused to engage the inner tappet with the valve plunger and disengage the outer tappet from the valve plunger to operate in a four-stroke mode.

8. The mechanism according to claim 7, wherein the first pair of springs is disposed between said first pair of pins.

9. The mechanism according to claim 8, wherein the pressure fluid urges said first pair of pins radially inwardly of the inner tappet against the force of the first pair of springs to engage the inner tappet and the valve plunger and disengage the outer tappet and the valve plunger to operate in the four-stroke mode.

10. The mechanism according to claim 6, including an inner tappet return spring to urge the inner tappet into engagement with the four-stroke cam surface.

11. The mechanism according to claim 6, including an outer tappet return spring to urge the outer tappet into engagement with the two-stroke cam surface.

12. The mechanism according to claim 6, wherein the outer tappet engages two two-stroke cam surfaces.

13. A switching mechanism for switching an engine from one stroke type to another stroke type comprising:

a rocker assembly having a rocker arm operatively engaging a valve, a first follower arm operatively engaging a four-stroke cam surface of a cam shaft, and a second rocker arm operatively engaging a two-stroke cam surface of the cam shaft, said rocker assembly adapted to transform a rotary motion of the cam shaft to a linear motion of the valve; and a first pair of pins disposed in said rocker assembly, a first end of each of said first pair of pins in communication with a pressure fluid and a second end of each of said first pair of pins urged by a respective one of a pair of springs, whereby a change in pressure of the pressure fluid causes a movement of at least one of said first pair of pins to stop the transformation of motion from one of the two-stroke cam surface and the four-stroke cam surface to the valve.

14. The switching mechanism according to claim 13, wherein one of said first pair of pins is caused to engage and disengage the first follower arm and the other of said first pair of pins is caused to engage and disengage the second follower arm.

15. The switching mechanism according to claim 14, wherein the rocker assembly includes a pressure fluid chamber disposed between said first pair of pins.

16. The switching mechanism according to claim 14, including a second pair of pins, one of the second pair of pins disposed adjacent one of said first pair of pins and the other of the second pair of pins disposed adjacent the other of said first pair of pins, wherein the second pair of pins ensures proper alignment of the first pair of pins for engagement and disengagement of the first follower arm and the second follower arm.

17. A switching mechanism for switching an engine from one stroke type to another stroke type comprising:

a tappet assembly including an outer tappet operatively engaging a two-stroke cam surface of a cam shaft, an inner tappet operatively engaging a four-stroke cam surface of the cam shaft, and a valve plunger operatively engaging a valve, said tappet assembly adapted to transform a rotary motion of the cam shaft to a linear motion of the valve; and a pair of pins disposed in said tappet assembly, a first end of each of said pins in communication with a pressure fluid and a second end of each of said pins urged by respective ones of a pair of springs, whereby a change in pressure of the pressure fluid causes a movement of at least one of said pins to stop the transformation of motion from one of the two-stroke cam surface and the four-stroke cam surface to the valve.

18. The mechanism according to claim 17, wherein said pins are caused to engage the outer tappet with the valve plunger and disengage the inner tappet from the valve plunger to operate in a two-stroke mode, and said pins are caused to engage the inner tappet with the valve plunger and disengage the outer tappet from the valve plunger to operate in a four-stroke mode.

19. The mechanism according to claim 18, wherein the pressure fluid urges said pins radially inwardly against the force of the springs to engage the inner tappet and the valve plunger and disengage the outer tappet and the valve plunger to operate in the four-stroke mode.

20. The mechanism according to claim 17, wherein the springs are disposed between said pins.

21. A switching mechanism for switching an engine from one stroke type to another stroke type comprising:

a rocker assembly having a cavity formed therein, the cavity of said rocker assembly having a first piston and a shuttle pin disposed therein, the first piston and the shuttle pin being reciprocatable between a first position and a second position by means of hydraulic pressure, the first piston and the shuttle pin urged towards the first position against the means of hydraulic pressure by a first spring;

a first follower arm adapted to follow a first cam surface of a cam shaft;

a second follower arm adapted to follow a second cam surface of a cam shaft, wherein said first follower arm is connected to operatively engage a valve stem in the engine when the shuttle pin is in the first position and the second follower arm is connected to operatively engage the valve stem in the engine when the shuttle pin is in the second position;

a hydraulic lash adjustment device disposed between the valve stem and the rocker assembly to compensate for clearances therebetween; and means for deactivating said hydraulic lash adjustment device actuated during movement of said shuttle pin between the first position and the second position.

22. The switching mechanism according to claim 21, wherein said hydraulic lash adjustment device includes a second piston abutting the valve stem and a second spring urging the piston towards the valve stem.

23. The switching mechanism according to claim 21, wherein said hydraulic lash adjustment device is selectively engagable and disengagable by said means for deactivating controlling a flow of pressure fluid to said hydraulic lash adjustment device through a groove formed on said shuttle pin.

* * * * *